US007987659B2

(12) United States Patent
Song

(10) Patent No.: US 7,987,659 B2
(45) Date of Patent: Aug. 2, 2011

(54) TWISTED ELECTRIC HEATING CABLES AND METHOD FOR MANUFACTURING THEREOF

(76) Inventor: Jong Seok Song, Busan (KR)

( * ) Notice: Subject to any disclaimer, the term of this patent is extended or adjusted under 35 U.S.C. 154(b) by 163 days.

(21) Appl. No.: 12/092,546

(22) PCT Filed: Nov. 13, 2006

(86) PCT No.: PCT/KR2006/004731

§ 371 (c)(1),
(2), (4) Date: Dec. 31, 2008

(87) PCT Pub. No.: WO2008/059997

PCT Pub. Date: May 22, 2008

(65) Prior Publication Data

US 2009/0188231 A1 Jul. 30, 2009

(51) Int. Cl.
*D02G 3/02* (2006.01)

(52) U.S. Cl. ..... 57/314; 57/236

(58) Field of Classification Search ..... 57/236, 57/241, 314

See application file for complete search history.

(56) References Cited

U.S. PATENT DOCUMENTS

| | | | | |
|---|---|---|---|---|
| 4,574,574 | A * | 3/1986 | Knaak | 57/59 |
| 5,486,649 | A | 1/1996 | Gareis | |
| 5,666,452 | A | 9/1997 | Gregory et al. | |
| 6,378,283 | B1 * | 4/2002 | Barton | 57/58.52 |
| 2006/0059883 | A1 * | 3/2006 | Hopkinson et al. | 57/236 |

FOREIGN PATENT DOCUMENTS

| | | |
|---|---|---|
| JP | 10-321356 | 12/1998 |
| JP | 2002-313543 | 10/2002 |
| KR | 10-0649334 | 11/2006 |

* cited by examiner

*Primary Examiner* — Shaun R Hurley

(74) *Attorney, Agent, or Firm* — Park & Associates IP Law, P.C.

(57) ABSTRACT

Disclosed herein is an electric heating cable which is used in an electric heating apparatus and minimizes an electromagnetic field effect. The electric heating cable is manufactured by twisting first and second electric heating strands in three axial directions. Each electric heating strand includes a core wire comprising a stranded wire of a resistor, and an insulating sheath made of fluorine resin. According to the invention, the electric heating cable is resistive to untwisting in a free state even if no adhering means is used, and is compactly twisted, so that the electric heating cable maintains a secured state and has superior flexibility, while reducing leakage flux, and the electric heating cable has a reduced outer diameter and is light, so that it is useful for a thin electric heating apparatus, and incurs a low manufacturing cost.

6 Claims, 3 Drawing Sheets

【Figure 4】
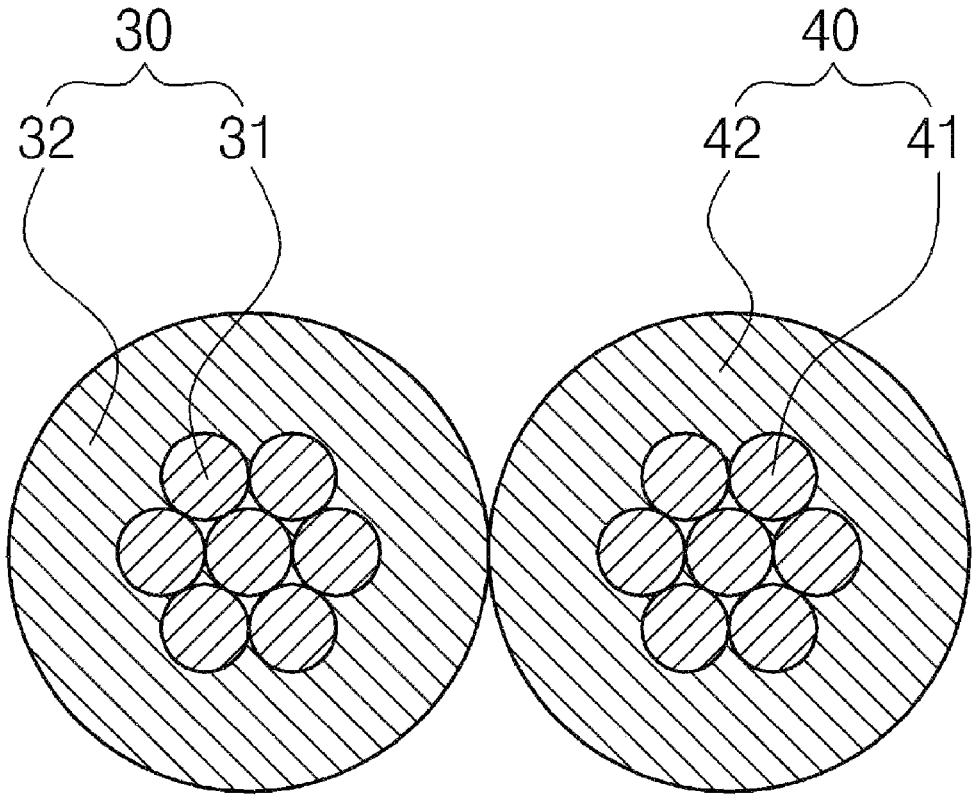
【Figure 5】
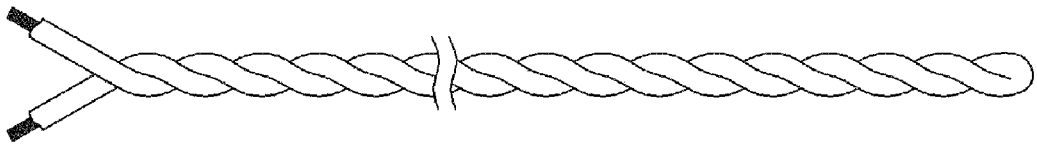

【Figure 6】
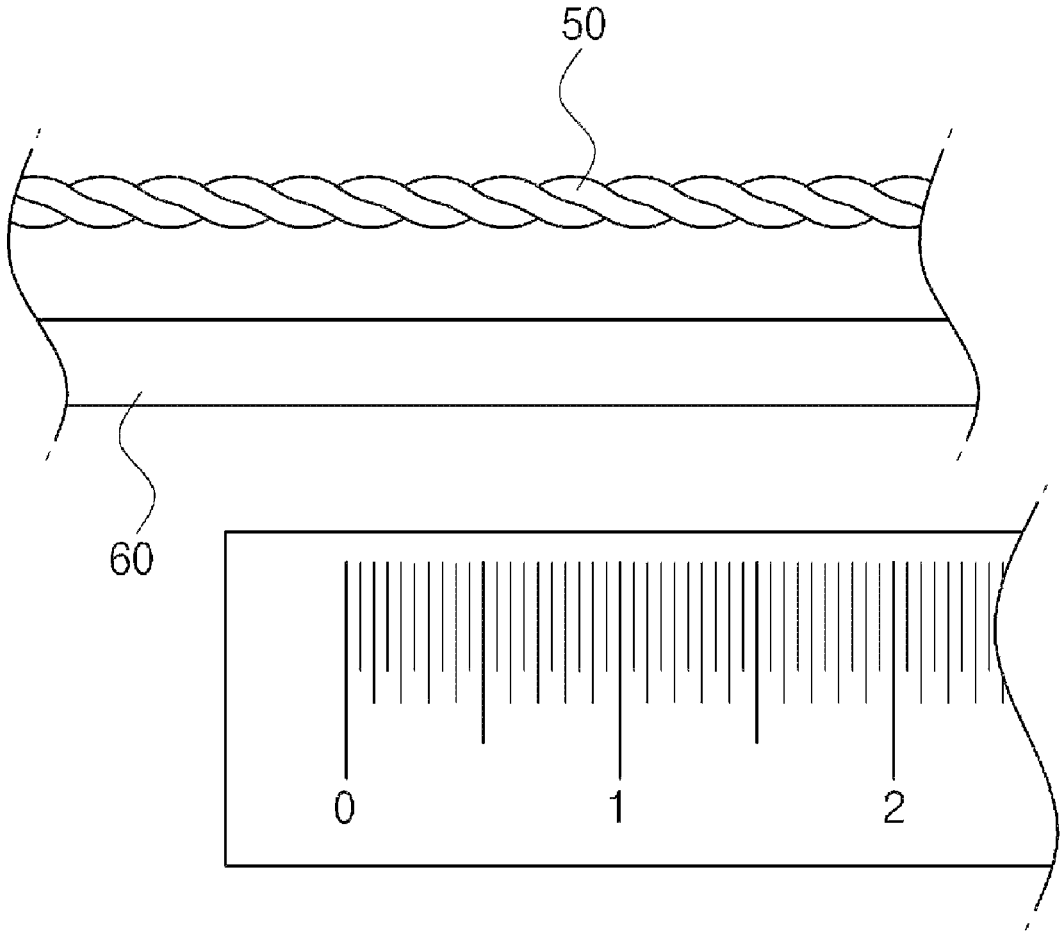

TWISTED ELECTRIC HEATING CABLES AND METHOD FOR MANUFACTURING THEREOF

RELATED APPLICATIONS

This application claims priority based on International Patent Application No. PCT/KR2006/004731, filed Nov. 13, 2006, entitled "Twisted Electric Heating Cables And Method For Manufacturing Thereof" by Jong Seok Song.

TECHNICAL FIELD

The present disclosure relates, in general, to electric heating cables which are used in an electric heating apparatus for keeping a person warm using electricity, such as an electric heating mattress or an electric blanket, and, more particularly, to a twisted electric heating cable for preventing leakage flux, which is manufactured by integrally twisting two heating strands so as to minimize an electromagnetic field, which is harmful to a person.

BACKGROUND

The intensity of a magnetic field at points varying distances from an electric cable decreases in proportion to the distance. Unlike a general electric apparatus that is used at a position spaced apart from a person by several meters, an electric heating apparatus for keeping a person warm contacts his or her body, that is, is spaced apart from the body by a small distance of about several centimeters. Thus, the magnetic field to which the body is exposed has a density several ten times or several hundred times as high as the general electric apparatus. Therefore, an electric heating cable of such an electric heating apparatus requires a structure that reduces leakage flux. In order to satisfy the requirements, various types of electric heating cables for preventing leakage flux have been developed. Among the electric heating cables, a coaxial electric heating cable for preventing leakage flux which is similar to that of Korean Patent No. 018436 has been widely used. FIG. 1 shows a coaxial electric heating cable, with part of the outer circumferential surface of the cable cut away.

The coaxial electric heating cable includes core wires 11, an insulating inner covering 12, an outer heating wire 13, and an insulating outer covering 14. The core wires 11 are annealed copper stranded wires. The insulating inner covering 12 covers the outside of the core wires 11, and is made of nylon or Teflon, having superior heat resistance. The outer heating wire 13 is spirally wound around the outer circumference of the insulating inner covering 12. The insulating outer covering 14 covers the surface of the outer heating wire 13, and is made of an insulating material, such as silicone or polyvinyl chloride (PVC). The outer heating wire 13 is obtained by forming a resistor, such as a circular or polygonal nichrome wire, in a circular or ribbon shape. Current flows in the core wires 11 and the outer heating wire 13 in opposite directions, thus offsetting magnetic fields, therefore eliminating leakage flux.

Such a coaxial electric heating cable is constructed so that the core wires 11, the insulating inner covering 12, the outer heating wire 13, and the insulating outer covering 14 are layered in multiple layers. Thus, the coaxial electric heating cable is thick and relatively inflexible. Especially, since the insulating inner covering 12 directly applies power to the core wires 11 and the outer heating wire 13, and is present inside the outer heating wire 13, both heat resistance and ability to withstand voltage must be ensured.

Thus, even if fluorine resin, having superior mechanical and thermal properties, is used for the insulating inner covering, a considerable thickness is required. Thereby, the diameter of most practical products exceeds 2.5 mm. Meanwhile, if the insulating outer covering 14 is made of silicone or vinyl chloride, which has relatively lower mechanical strength, the diameter of the product is 3 mm or so. Thus, when the coaxial electric heating cable is applied to a thin electric heating apparatus, the coaxial electric heating cable protrudes from the electric heating apparatus. When the insulating outer covering 14 is made of fluorine resin, thus reducing the diameter of the coaxial electric heating cable, the manufacturing cost is increased, and in addition, productivity is reduced due to high-temperature extrusion.

Further, when external shocks act on the outer heating wire 13, that is, when the coaxial electric heating cable is folded, the outer heating wire is gathered to one side, so that the interval between spiral parts of the outer heating wire is narrowed. Thereby, one surface of the coaxial electric heating cable is overheated, so that the insulating material melts or is damaged. Moreover, the outer heating wire 13 is apt to short, which thus increases leakage flux.

An electric heating cable for suppressing leakage flux in a method different from that of the coaxial electric heating cable has been proposed. FIG. 2 shows the basic construction of a dual insulating twisted electric heating cable, with part of the outer circumferential surface of the cable cut away.

As shown FIG. 2, the dual insulating twisted electric heating cable is manufactured by pulling and rotating two electric heating strands 20, or by pulling and twisting the two electric heating strands 20 while simultaneously rotating the electric heating strands. Each electric heating strand 20 includes core wires 21, which are stranded wires of a resistor, such as a nichrome wire, and an insulating inner covering 22 which is made of high-temperature resin, such as fluorine resin. The twisted electric heating strands 20 are covered with an insulating outer covering 23 so that the electric heating strands are in close contact with each other and do not come untwisted. Current flows in the two electric heating strands 20 in opposite directions, so that magnetic fields are offset with each other, and thus leakage flux is reduced. Korean U.M. Registration No. 0317437 and Korean U.M. Registration No. 0176447 disclose examples implementing the dual insulating twisted electric heating cable.

In such a dual insulating twisted heating cable, the interval between the core wires 21 to which power is applied is equal to twice the thickness of the insulating inner covering 22. Thus, even though the thickness of the insulating inner covering 22 is reduced to the maximum within the range that exhibits desired mechanical and thermal properties, the cable has considerable ability to withstand voltage. Unlike the coaxial electric heating cable, the phenomenon where the outer heating wire 13, which is spirally wound, gathers at one side does not occur. However, the total diameter is still thick, due to dual insulation, and flexibility is poor. Thus, when the dual insulating twisted heating cable is applied to a thin electric heating apparatus, the dual insulating twisted heating cable protrudes. Due to the process of applying the insulating outer covering 23, the dual insulating twisted heating cable is disadvantageous in terms of cost and productivity.

Most of the drawbacks of the coaxial electric heating cable and the dual insulating twisted heating cable are overcome if the twisted heating cable is used without the insulating outer covering 23. However, when a twisted electric heating cable, made by performing rotation with respect to only one axis, is able to freely move without restriction, or the electric heating apparatus in which the twisted electric heating cable is embedded becomes deformed, space is formed between the electric heating strands, and thus leakage flux is not efficiently suppressed.

In order to solve the drawback of the twisted electric heating cable, U.S. Pat. No. 6,734,404 proposes a method for preventing two electric heating strands from coming untwisted via a means for adhering the electric heating strands to each other, thus removing the insulating outer covering 23.

However, the adhering means must adhere a material having a low frictional coefficient, such as fluorine resin, must not be deformed, and must not lose its ability to adhere the electric heating strands, even when temperatures of 100° C. or more are reached in an electric heating apparatus. Further, the adhering means must have tensile strength and flexibility sufficient to withstand mechanical damage when a thin electric heating apparatus is abruptly bent. However, it is very difficult to obtain an adhering means satisfying the above-mentioned requirements. Further, the manufacturing cost is increased because of the adhering means, and productivity is reduced because of the need to apply the adhering means.

TECHNICAL PROBLEM

Accordingly, the present invention has been made keeping in mind the above problems occurring in the conventional electric heating cable for preventing leakage flux, and an object is to provide a twisted electric heating cable and manufacturing method thereof, in which the electric heating cable is resistive to untwisting in a free state even if an adhering means, such as an adhesive, is not used, and is compactly twisted, so that the electric heating cable maintains a secured state and has superior flexibility, while reducing leakage flux, and in which the electric heating cable has a small outer diameter, so that it is useful for a thin electric heating apparatus, and is low in manufacturing cost.

TECHNICAL SOLUTION

In order to accomplish the object, an embodiment of the present invention provides a method for manufacturing a twisted electric heating cable, including inputting and twisting first and second electric heating strands in symmetrical directions, wherein an angle between an axial line along which the first and second electric heating strands are twisted and an axial line along which the first electric heating strand is input is equal to an angle between the axial line along which the first and second electric heating strands are twisted and an axial line along which the second electric heating strand is input, and the axial line along which the first electric heating strand is input, the axial line along which the second electric heating strand is input, and the axial line along which the first and second electric heating strands are twisted are simultaneously rotated in the same direction.

A rotating speed of the axial line along which the first electric heating strand is input is equal to a rotating speed of the axial line along which the second electric heating strand is input, and the rotating speed of the axial line along which each of the first and second electric heating strands is input is faster than a rotating speed of the axial line along which the first and second electric heating strands are twisted.

An embodiment of the present invention provides a method for manufacturing a twisted electric heating cable, including twisting first and second electric heating strands, each of the first and second electric heating strands comprising a core wire made of a material for a stranded wire of a resistor, and an insulating sheath covering an outer circumference of the core wire and made of fluorine resin, wherein an angle between an axial line along which the first and second electric heating strands are twisted and an axial line along which the first electric heating strand is input is equal to an angle between the axial line along which the first and second electric heating strands are twisted and an axial line along which the second electric heating strand is input, and the axial line along which the first electric heating strand is input, the axial line along which the second electric heating strand is input, and the axial line along which the first and second electric heating strands are twisted are simultaneously rotated in the same direction.

A rotating speed of the axial line along which the first electric heating strand is input is equal to a rotating speed of the axial line along which the second electric heating strand is input, and the rotating speed of the axial line along which each of the first and second electric heating strands is input is faster than a rotating speed of the axial line along which the first and second electric heating strands are twisted.

The first and second electric heating strands comprise one strand, the strand being folded at a center thereof and then twisted.

ADVANTAGEOUS EFFECTS

As described above, embodiments of the present invention provide a twisted electric heating cable and a manufacturing method thereof, in which the electric heating cable does not come untwisted when unrestrained, even if an adhering means, such as an adhesive, is not used, and is compactly twisted, so that the electric heating cable maintains a state of closer contact and has superior flexibility, thus reducing leakage flux, and in which the electric heating cable has a small outer diameter and is light, so that it is useful in a thin electric heating apparatus, and is cheap to manufacture.

The accompanying drawings, which are incorporated into and constitute a part of this specification, illustrate one or more examples of embodiments and, together with the description of example embodiments, serve to explain the principles and implementations of the embodiments.

In the drawings:

FIG. 4 is a sectional view showing one example of the twisted electric heating cable, according to the present invention;

FIG. 5 is a side view showing one example of the twisted electric heating cable, according to the present invention; and FIG. 6 is a view comparing a twisted electric heating cable manufactured according to the invention with a conventional coaxial electric heating cable.

DETAILED DESCRIPTION

Hereinafter, a 3-axis twisted electric heating cable according to a presently preferred embodiment of the present invention will be described in detail with reference to the accompanying drawings.

Figure 1:
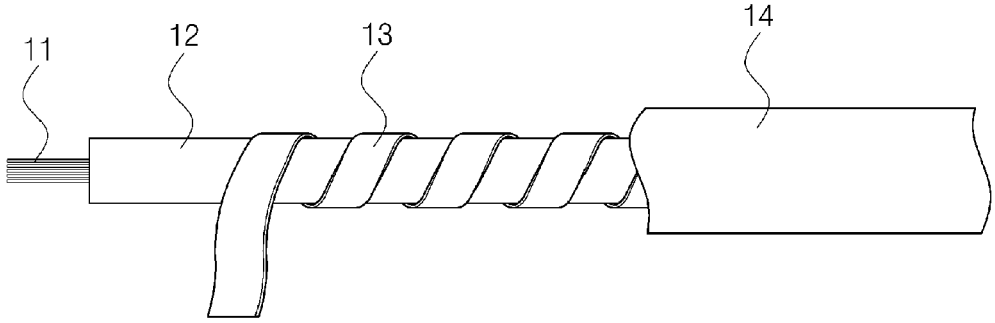
Fig. 1 (Prior Art)
FIG. 1 is a side view showing a conventional coaxial electric heating cable for preventing leakage flux, with part of the coaxial electric heating cable cut away.
Figure 2:
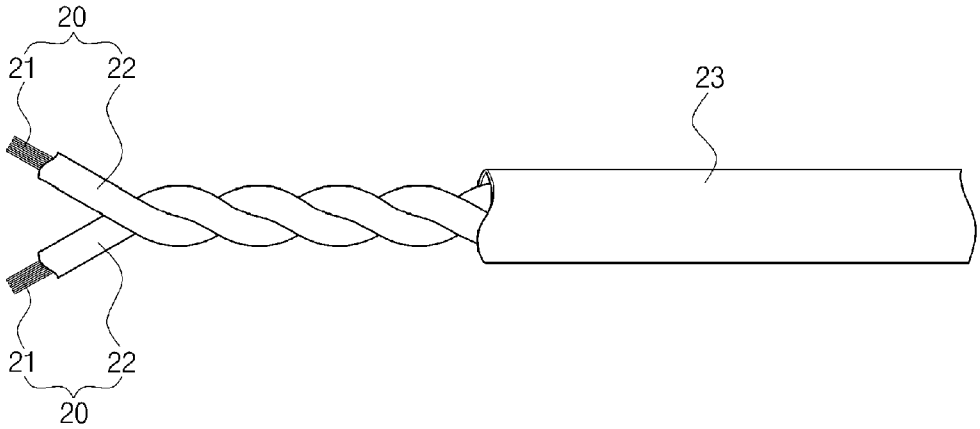
Fig. 2 (Prior Art)
FIG. 2 is a side view showing a conventional dual insulating twisted electric heating cable for preventing leakage flux, with part of the dual insulating twisted electric heating cable cut away.
Figure 3:
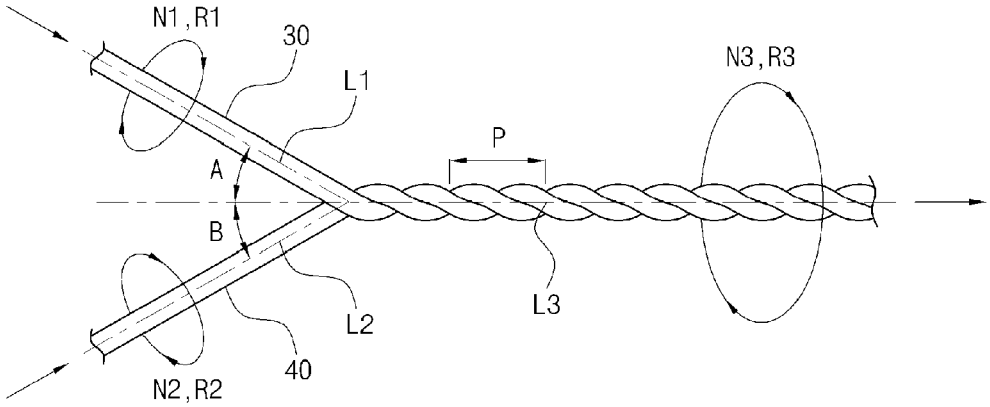
FIG. 3 is a view showing a three-axis twisting method of a twisted electric heating cable, according to the present invention.

FIG. 3 shows a method of twisting a twisted electric heating cable, according to an embodiment of the present invention, and FIG. 4 is a sectional view showing the twisted electric heating cable according to an embodiment of the present invention.

Referring to FIGS. 3 and 4, the twisted electric heating cable comprises two electric heating strands, that is, first and second electric heating strands 30 and 40. Each of the first and second electric heating strands 30 and 40 includes core wires 31 or 41, which comprise stranded wires of a resistor, such as a nichrome wire, and an insulating sheath 32 or 42 made of high-temperature resin, such as fluorine resin. The core wires 31 and 41 of the first and second electric heating strands 30 and 40 are made of the same material, and the insulating sheaths 32 and 42 of the first and second electric heating strands 30 and 40 are made of the same material.

As shown in FIG. 3, in the twisted electric heating cable, the first and second electric heating strands 30 and 40 are input along different axial lines L1 and L2, and are pulled and twisted in the axial line direction L2 where the first and second electric heating strands 30 and 40 are twisted.

The axial line L1, along which the first electric heating strand 30 is input, and the twisted axial line L3 form an angle A, while the axial line L2, along which the second electric heating strand 40 is input, and the twisted axial line L3 form an angle B. The angle A and the angle B are the same size and are formed in opposite directions. The rotation direction R1 around the axial line L1 along which the first electric heating strand 30 is input, the rotation direction R2 around the axial line L2 along which the second electric heating strand 40 is input, and the rotation direction R3 around the axial line L3 along which the first and second electric heating strands 30 and 40 are twisted are the same.

Here, when the rotating speed N1 around the axial line L1 along which the first electric heating strand 30 is input is equal to the rotating speed N2 around the axial line L2 along which the second electric heating strand 40 is input, the twist balance of the first and second electric heating strands 30 and 40 is good, and thus the amount of flux of the first electric heating strand is almost exactly equal to the amount of flux of the second electric heating strand. Thereby, leakage flux is remarkably reduced.

Further, when the rotating speed N1 of the first electric heating strand 30 and the rotating speed N2 of the second electric heating strand 40 are equal to or faster than the rotating speed N3 of the twisted axial line L3, the first and second electric heating strands 30 and 40 are smoothly twisted. Further, the insulating sheaths 32 and 42 and the core wires 31 and 41 themselves are twisted, so that the twisted electric heating cable becomes more flexible. The twist pitch P becomes sufficiently narrow, so that a state of closer contact is ensured. Thus, even in the free state where the twisted electric heating cable is not constrained, the twisted electric heating cable does not come untwisted.

That is, an embodiment of the present invention uses the 3-axis twist method where the electric heating strands are rotated individually in 3-axis directions and are twisted.

According to an embodiment of the present invention, the electric heating strands are continuously input and are twisted in three axes, thus manufacturing the 3-axis twisted electric heating cable. Subsequently, the twisted electric heating cable is cut to the desired length prior to being used. Alternatively, as shown in FIG. 5, one electric heating strand is folded at a central position thereof, and is twisted in 3 axes, thus manufacturing a 3-axis twisted electric heating cable. Such a method can eliminate the complicated procedure of coupling the ends of the 3-axis twisted electric heating cable.

Further, the 3-axis twisted electric heating cable needs no sheath except for the basic insulating sheaths 32 and 42, so that the insulating material of the cable may use fluorine resin, such as PTFE or FEP, having superior thermal properties, electric properties, and mechanical properties including tensile strength and abrasion resistance.

FIG. 6 is a view comparing a twisted electric heating cable 50 of one embodiment of the invention with a conventional coaxial electric heating cable 60. The twisted electric heating cable 50 is manufactured using an electric heating strand, in which FEP is used as the material for the insulating sheath, the outer diameter of the core wires, comprising 7 strands of resistors, is 0.6 mm, and the outer diameter of the insulating sheath is 1.0 mm.

Referring to FIG. 6, the outer diameter of the twisted electric heating cable 50 of one embodiment does not exceed 2.0 mm, the twist pitch is 10 mm or less, ability to withstand voltage between two electric heating strands is 5 kV or more, and inductance is 1 uH or less per 1 m. Even when the core wires reach a temperature of 150° C., no deformation or damage occurs due to heat. Even if the twisted electric heating cable is wound around a rod having a diameter of 5 mm, the electric heating cable does not come untwisted. Further, the twisted electric heating cable has a weight corresponding to 40% of the weight of a coaxial electric heating cable having similar heat emission characteristics, and uses silicone as an insulating sheath, so that the consumption of material is remarkably reduced.

The invention claimed is:

1. A method for manufacturing a twisted electric heating cable, comprising:

inputting and twisting first and second electric heating strands in angled arrangement, wherein an angle between a first axial line along which the first and second electric heating strands are twisted and a second axial line along which the first electric heating strand is input is equal to an angle between the first axial line along which the first and second electric heating strands are twisted and a third axial line along which the second electric heating strand is input, and wherein the second axial line along which the first electric heating strand is input, the third axial line along which the second electric heating strand is input, and the first axial line along which the first and second electric heating strands are twisted are simultaneously rotated in the same direction such that the twisted first and second electric heating strands are resistive to untwisting so as to maintain the twisted state without loosening.

2. The method of claim 1, wherein a rotating speed of the second axial line along which the first electric heating strand is input is equal to a rotating speed of the third axial line along which the second electric heating strand is input, and the rotating speed of the second and third axial lines along which each of the first and second electric heating strands is input is faster than a rotating speed of the first axial line along which the first and second electric heating strands are twisted.

3. The method of claim 1, wherein the first and second electric heating strands are provided from one strand, with the strand being folded at a center thereof and then twisted.

4. A method for manufacturing a twisted electric heating cable, comprising:

twisting first and second electric heating strands, each of the first and second electric heating strands comprising a core wire made of a material for a stranded wire of a resistor, and an insulating sheath covering an outer circumference of the core wire and made of fluorine resin, wherein an angle between a first axial line along which the first and second electric heating strands are twisted and a second axial line along which the first electric heating strand is input is equal to an angle between the first axial line along which the first and second electric heating strands are twisted and a third axial line along which the second electric heating strand is input, and wherein the second axial line along which the first electric heating strand is input, the third axial line along which the second electric heating strand is input, and the first axial line along which the first and second electric heating strands are twisted are simultaneously rotated in the same direction.

5. The method of claim 4, wherein a rotating speed of the second axial line along which the first electric heating strand is input is equal to a rotating speed of the third axial line along which the second electric heating strand is input, and the rotating speed of the second and third axial lines along which each of the first and second electric heating strands is input is faster than a rotating speed of the first axial line along which the first and second electric heating strands are twisted.

6. The method of claim 4, wherein the first and second electric heating strands are provided from one strand, with the strand being folded at a center thereof and then twisted.

* * * * *